United States Patent [19]

Fetterolf et al.

[11] Patent Number: 4,588,852

[45] Date of Patent: May 13, 1986

[54] STABLE IMPEDANCE RIBBON COAX CABLE

[75] Inventors: James R. Fetterolf, Mechanicsburg; Jeffrey K. Fisher, Harrisburg, both of Pa.

[73] Assignee: AMP Incorporated, Harrisburg, Pa.

[21] Appl. No.: 684,527

[22] Filed: Dec. 21, 1984

[51] Int. Cl.[4] ..... H01B 7/34

[52] U.S. Cl. ..... 174/36; 174/103; 174/115; 174/117 F

[58] Field of Search ..... 174/36, 103, 115, 117 F

[56] References Cited

U.S. PATENT DOCUMENTS

| | | | |
|---|---|---|---|
| 2,981,788 | 4/1961 | Bunish | 174/103 |
| 3,775,552 | 11/1973 | Schumacher | 174/36 X |
| 3,829,603 | 8/1974 | Hansen et al. | 174/115 |
| 4,096,346 | 6/1978 | Stine et al. | 174/36 |
| 4,234,759 | 11/1980 | Harlow | 174/115 X |
| 4,488,125 | 12/1984 | Gentry et al. | 174/115 X |

FOREIGN PATENT DOCUMENTS

| | | | |
|---|---|---|---|
| 2008284 | 6/1983 | German Democratic Rep. | 174/115 |

OTHER PUBLICATIONS

Miller, A. K.; Cutting the Crosstalk; Machine Design; vol. 57, No. 10; p. 86; May 9, 1985.

*Primary Examiner*—Arthur T. Grimley
*Assistant Examiner*—Morris H. Nimmo

[57] ABSTRACT

A ribbon coax cable comprises a plurality of parallel and coplanar center conductors each surrounded by a dielectric sheath, a conductive member surrounding each dielectric sheath, a plurality of coplanar drain conductors each of which extends parallel to a respective center conductor and in electrical engagement with the conductive member, an elastomeric material surrounding the conductive members and the drain conductors which maintains the drain conductors and the conductive members in electrical engagement along the entire length of the cable.

14 Claims, 2 Drawing Figures

STABLE IMPEDANCE RIBBON COAX CABLE

FIELD OF THE INVENTION

This invention relates to an electrical cable and more particularly to a ribbon coax cable having a stable impedance.

BACKGROUND OF THE INVENTION

Ribbon coax cable of the type disclosed in U.S. Pat. No. 3,775,552 is well known and used extensively in electronic equipment. This cable has proven most effective because the signal conductors are properly shielded by the outer conductors enabling transmission of signal information free of interference and the signal and drain conductors are able to be mass terminated in electrical conductors because the drain conductors extend along the cable parallel to the signal conductors in a coplanar manner which assures that the drain conductors will always be in a specified position when the cable is stripped and the exposed signal and drain conductors are terminated in terminating sections of electrical terminals of an electrical connector.

Ribbon coax cables are subjected to flexing, torquing, vibration, and pressure and temperature variations which can result in discontinuities occurring along the cable creating varying impedance thereby causing signal errors to occur within the electronic circuits of the electronic equipment. In order to overcome this serious problem, the drain conductors must maintain electrical contact with the outer conductors along the entire length of the cable during such flexing, torquing, vibrating, and pressure and temperature variations of the cable thereby providing a stable impedance ribbon coax cable.

SUMMARY OF THE INVENTION

According to the present invention, a ribbon coax cable comprises a plurality of parallel and coplanar center conductors each surrounded by a dielectric sheath, a conductive member surrounding each dielectric sheath, a plurality of coplanar drain conductors each of which extends parallel to a respective center conductor and in electrical engagement with the conductive member, an elastomeric material surrounding the conductive members and the drain conductors, which maintains the drain conductors and the conductive members in electrical engagement along the entire length of the cable.

DETAILED DESCRIPTION OF THE INVENTION

Figure 1:
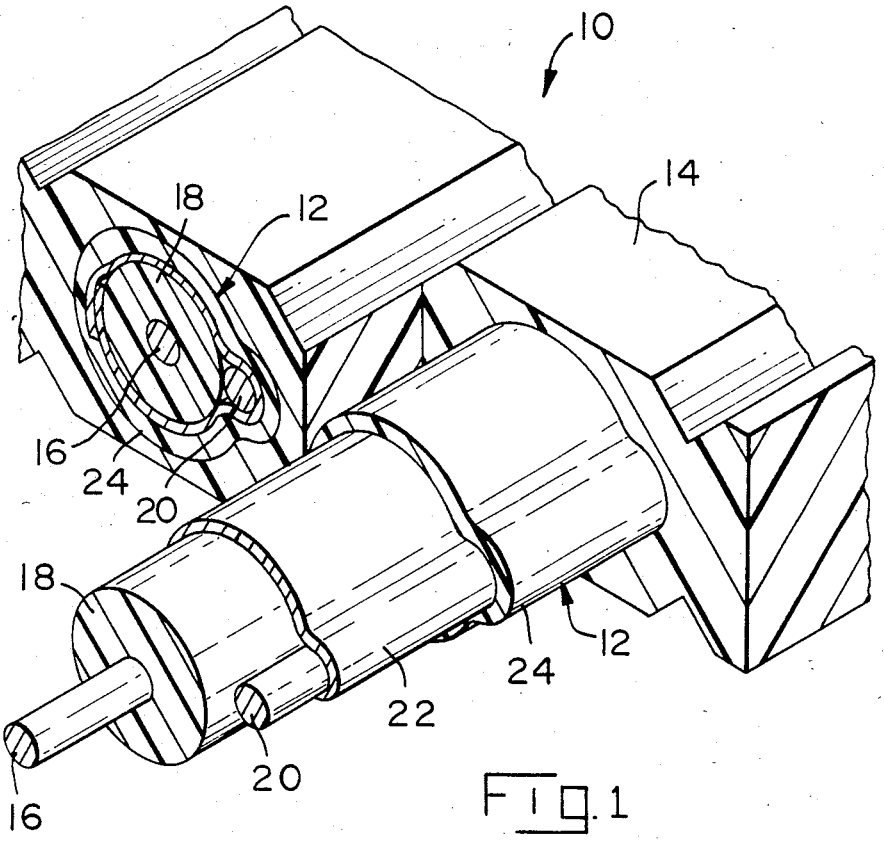
FIG. 1 is a cross-sectional view of a ribbon coax cable with parts broken away.
Figure 2:
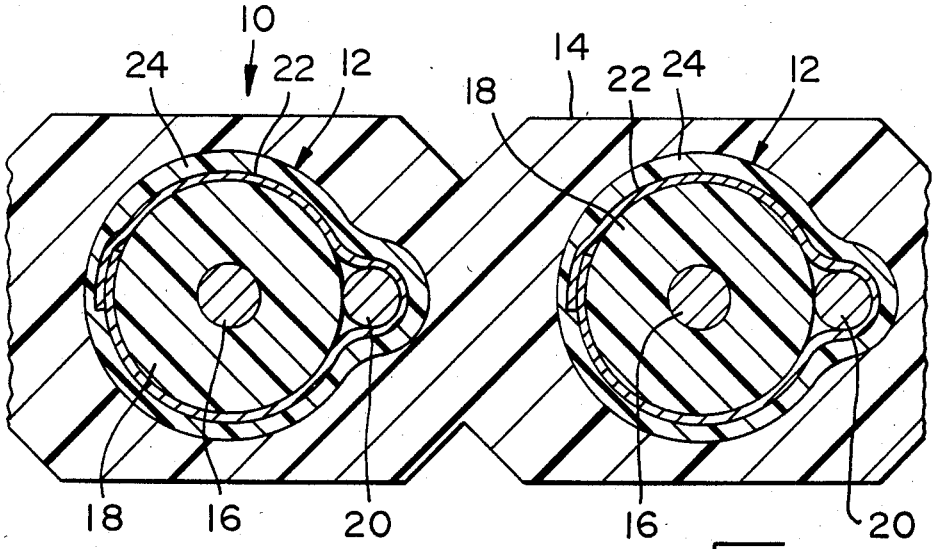
FIG. 2 is a front elevational view in cross section of FIG. 1

FIGS. 1 and 2 show a ribbon coax cable 10 that includes individual coax cable units 12 encompassed within an outer dielectric jacket 14 which maintains the coax cable units 12 in a substantially planar configuration. The number of coax cable units 12 can vary between two and fifty, but this is a representative number.

Each coax cable unit 12 includes a center conductor 16, a dielectric sheath 18 covering center conductor 16, a drain conductor 20, an outer conductor 22, and an elastomeric member 24. Center conductor 16 is a cylindrical wire having its axis coincident with the axis of the coax cable unit, but a helical or a twisted center conductor may be used. Any of the various known materials in manufacturing processes for constructing center conductors may be employed, for example, copper, aluminum, and copper-clad aluminum.

Dielectric sheath 18 surrounds center conductor 18 and separates it from outer conductor 22 along the length thereof. Dielectric sheath 18 is composed of conventionally known dielectric materials and made by conventional manufacturing processes. Dielectric sheath 18 is made of materials such as, for example, a polymer material such as polytetrafluoroethylene or polyethylene which can be either foamed or unfoamed, laminates, and any other known combinations of materials and manufacturing processes conventionally employed for construction of dielectrics and coaxial cables.

Outer conductor 22 is constructed from conventional materials used as outer conductors or shields in coaxial or multiconductor cable and can be made of copper, aluminum, or metal and plastic laminates. The outer conductor 22 may be in the form of helically or longitudinally wrapped structures such tapes, ribbons, or tubular structures. The outer conductors may be bonded to adjacent parts of the cable using a commercially available adhesive.

As shown in FIGS. 1 and 2, outer conductor 22 is a longitudinally pulled "cigarette wrapped" laminate that extends around dielectric sheath 18 and drain conductor 20 and is adhered to dielectric sheath 18 along its length.

Drain conductor 20 is positioned parallel to center conductor 16 and can be positioned coplanar therewith or can be positioned coplanar with the other drain conductors 20 of the other coax cable units. The important thing is that drain conductors 20 be disposed parallel with center conductors 16 along the entire length of cable 10 so that when the cable is stripped to bare center conductors 16 and drain conductors 20 for mass termination into respective terminating sections of electrical terminals in an electrical connector, drain conductors 20 will always be at a specified location for such mass termination.

In order to make certain that drain conductors 20 and outer conductors 22 are always in electrical engagement along the entire length of cable 10, elastomeric member 24 is disposed therearound, as shown in FIGS. 1 and 2, so that the elastic characteristics of elastomeric member 24 will maintain drain conductors 20 in engagement with respective dielectric sheaths 18 and outer conductors 22 in intimate contact with respective drain conductors 20 along the entire length of cable 10. Such an arrangement assures that no discontinuities occur between outer conductors 22 and respective drain conductors 20 along the entire length of cable 10 during flexing, torquing, vibrating, and pressure and temperature variations of the cable thereby providing a stable impedance ribbon coax cable at all times.

Elastomeric member 24 is a commercially available silicone material that withstands temperature variations and flexing, has low creep characteristics, is not affected by pressure, and is nonhydroscopic.

Outer dielectric jacket 14 is polyethylene or other suitable dielectric material in which coax cable units 12 are equally spaced therealong to maintain the coax cable units in a ribbon form so that center conductors 16 and drain conductors 20 can be mass terminated in the respective terminating sections of electrical terminals of an electrical connector.

The manufacture of ribbon coax cable 10 is in accordance with conventional cable-manufacturing practices. Dielectric sheaths 18 are extruded onto center conductors 16 whereafter drain conductors are disposed against dielectric sheaths 18 in a preselected position thereagainst so long as drain conductors 20 are coplanar with center conductors 16 or coplanar with other drain conductors 20, and outer conductors are adhesively adhered to dielectric sheaths 18 in a cigarette-wrap configuration thereby electrically engaging drain conductors 20 and positioning them against sheaths 18. Elastomeric members 24 are then extruded onto outer conductors 22 so that the elastic characteristics of elastomeric members 24 force outer conductors 22 against drain conductors 20 so that the elastic forces of elastomeric members 24 maintain outer conductors 22 in tight engagement with dielectric sheaths 18 and outer conductors 22 maintain drain conductors 20 in engagement with dielectric sheaths 18 as well as maintaining outer conductors 22 in electrical engagement with drain conductors 20 along the entire lengths of the coax cable units 12. Outer dielectric jacket 14 is extruded onto the coax cable units 12 thereby forming the cable 10 into its ribbon coax configuration with the center of center conductors 16 being at equally spaced intervals which also positions drain conductors 20 at equally spaced intervals and drain conductors 20 being parallel with center conductors 16 along the length of the cable will always be disposed at the same location at any position along cable 10.

From the foregoing, a ribbon coax cable has been disclosed which includes elastomeric members encompassing outer conductors of coax cable units which, through the elastic forces of the elastomeric members, maintain the outer conductors in intimate engagement with the dielectric sheaths surrounding the center conductors and also maintain the drain conductors in engagement with the dielectric sheaths as well as maintaining the outer conductors in electrical engagement with the drain conductors along the entire length of the cable thereby precluding any discontinuities which results in a stable impedance ribbon coax cable that will not be disrupted when the cable is subjected to flexing, torquing, and vibration forces in addition to pressure and temperature variations.

We claim:

1. A ribbon coaxial cable comprised of elongated and conductive drain conductors, elongated and conductive center conductors parallel with respective drain conductors, each center conductor being surrounded concentrically by a separate corresponding dielectric sheath, each said dielectric sheath and a corresponding drain conductor being mutually engaged along their corresponding lengths and together encircled by a separate corresponding conductive outer conductor, and a dielectric jacket containing the outer conductors, the improvement comprising, elastic means surrounding each outer conductor for urging each outer conductor in continuous engagement with a corresponding drain conductor, and said dielectric jacket surrounding said elastic means.

2. A ribbon coaxial cable comprising, elongated and conductive drain conductors, elongated and conductive center conductors parallel with respective drain conductors, each center conductor being surrounded concentrically by a separate corresponding dielectric sheath, each said dielectric sheath and a corresponding drain conductor being engaged along their corresponding lengths by a conductive corresponding outer conductor, elastic means containing each said corresponding outer conductor and a corresponding drain conductor for maintaining continuous engagement of each said corresponding outer conductor and a corresponding drain conductor, and a dielectric jacket surrounding said elastic means.

3. A ribbon coaxial cable as recited in claim 2, wherein each said corresponding outer conductor and a corresponding drain conductor are contained within a corresponding elastomeric member comprising said elastic means.

4. A ribbon coaxial cable as recited in claim 3, wherein each said corresponding outer conductor engages said elastic means.

5. A ribbon coaxial cable as recited in claim 3, wherein each said corresponding outer conductor has a wrap configuration.

6. A ribbon coaxial cable as recited in claim 3, wherein each said corresponding outer conductor is continuously surrounded and engaged by said elastic means.

7. A ribbon coaxial cable as recited in claim 2, wherein each said dielectric sheath and a corresponding drain conductor are mutually engaged along their corresponding lengths and together encircled by said corresponding conductive outer conductor.

8. A ribbon coaxial cable as recited in claim 7, wherein each said corresponding outer conductor and a corresponding drain conductor are contained within a corresponding elastomeric member comprising said elastic means.

9. A ribbon coaxial cable as recited in claim 7, wherein each said corresponding outer conductor engages said elastic means.

10. A ribbon coaxial cable as recited in claim 7, wherein each said corresponding outer conductor has a wrap configuration.

11. A ribbon coaxial cable as recited in claim 7, wherein each said corresponding outer conductor is continuously surrounded and engaged by said elastic means.

12. A ribbon coaxial cable as recited in claim 2, wherein each said corresponding outer conductor engages said elastic means,

13. A ribbon coaxial cable as recited in claim 2, wherein each said corresponding outer conductor has a wrap configuration.

14. A ribbon coaxial cable as recited in claim 2, wherein each said corresponding outer conductor is continuously surrounded and engaged by said elastic means.

* * * * *